US007874463B2

(12) United States Patent
Ciavarella

(10) Patent No.: US 7,874,463 B2
(45) Date of Patent: Jan. 25, 2011

(54) DISPENSER WITH COLLAPSIBLE DISPENSING TUBE

(75) Inventor: Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 391 days.

(21) Appl. No.: 12/075,829

(22) Filed: Mar. 14, 2008

(65) Prior Publication Data

US 2009/0230151 A1 Sep. 17, 2009

(51) Int. Cl.
*B67D 7/12* (2010.01)
*G01F 11/02* (2006.01)
*G01F 11/08* (2006.01)

(52) U.S. Cl. ..... 222/321.8; 222/321.7; 222/321.9; 222/181.3; 222/383.3

(58) Field of Classification Search ..... 222/181.3, 222/321.7–321.9, 383.1, 383.3, 385
See application file for complete search history.

(56) References Cited

U.S. PATENT DOCUMENTS 4,978,036 A * 12/1990 Burd ..... 222/181.2
6,053,370 A * 4/2000 Ludbrook et al. ..... 222/181.3
6,089,410 A * 7/2000 Ponton ..... 222/321.8
6,543,653 B2 * 4/2003 Lamboux ..... 222/321.8
7,377,408 B2 * 5/2008 Kasting et al. ..... 222/321.8
7,556,179 B2 * 7/2009 Yang et al. ..... 222/321.8
2007/0157991 A1 7/2007 Robertson
2007/0251953 A1 11/2007 Criswell et al.

* cited by examiner

*Primary Examiner*—Kenneth Bomberg

(57) ABSTRACT

A dispenser includes a housing and a push bar movable between a rest position and an actuated position. A container is retained in the housing and holds a liquid, and a pump is associated with a liquid. The pump is actuated to dispense a dose of the liquid, when the push bar is moved from its rest position to its actuated position. A dispensing tube includes an inlet associated with the pump, an outlet associated with the push bar, and a bellows portion between the inlet and the outlet. Upon moving the push bar from its rest position to its actuated position, the bellows portion is collapsed from an expanded volume to a compressed volume, and the outlet of the dispensing tube moves with the push bar. Upon return of the push bar from the actuated position to the rest position, the bellows portion expands from the compressed volume to the expanded volume, and draws liquid at the tip of the dispensing tube into the dispensing tube to reduce or eliminate dripping.

5 Claims, 3 Drawing Sheets

DISPENSER WITH COLLAPSIBLE DISPENSING TUBE

TECHNICAL FIELD

The invention herein resides in the art of liquid dispensers. More particularly, the invention relates to a dispenser having a push bar that is pushed to dispense fluid to a user's hand.

BACKGROUND OF THE INVENTION

For many years, it has been known to dispense liquids, such as soaps, sanitizers, cleansers, disinfectants, and the like from a dispenser housing maintaining a refill unit that holds the liquid and provides the pump mechanisms for dispensing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid. Accordingly, the standard liquid pump has given way to a foam generating pump, which necessarily requires means for combining the air and liquid in such a manner as to generate the desired foam. The concepts taught herein are applicable to both liquid and foam dispensers.

Of particular interest are those dispensers providing a push bar that is pushed from a rest position to an actuated position to actuate the pump mechanism and dispense foam to the operator's hand. Typically the dispensing tube extending from the pump mechanism is stationary and provides an outlet that is distanced from the push bar in its rest position. To dispense liquid, the operator cups his fingers under the outlet of the dispensing tube while pushing the push bar toward the outlet with the base of his palm. This dispenses the liquid through the outlet and onto his hand. This general structure presents some problems for those with small hands, as they may not be large enough to both engage the push bar and register with the outlet. For individuals with small hands, an initial dose of liquid may miss their hand and be dispensed to the floor or their clothing, that is, until their hand aligns under the outlet. For all individuals operating such dispensers, the dose of liquid is dispensed in a line across their hand because their hand moves relative to the outlet as the push bar is moved. In order to place the dose of liquid in a more consistent location on the operator's hand, some dispensers are structured such that the dispensing tube outlet is associated with the push bar to move with the push bar. Examples of such dispensers can be seen in U.S. Pat. Nos. 5,556,005, 5,797,517, 5,992,698, 6,648,179, and 7,198,177. The present invention improves on the general concept of associating the dispensing tube outlet to move with the push bar.

SUMMARY OF THE INVENTION

A dispenser in accordance with this invention includes a housing and a push bar movable between a rest position and an actuated position. A container is retained in the housing and holds a liquid. A pump is associated with the liquid in the container, and is actuated to dispense a dose of the liquid when the push bar is moved from its rest position to its actuated position. A dispensing tube includes an inlet associated with the pump, an outlet, and a bellows portion between the inlet and the outlet. The dispensing tube is secured to the push bar such that, upon moving the push bar from its rest position to its actuated position, the bellows portion is collapsed from an expanded volume to a compressed volume and the outlet moves with the push bar.

The concepts taught herein can be practiced to improve those dispensers that have a pump actuated by a pivoting push bar to dispense a dose of solution through an outlet in a dispensing tube. The improvement includes forming at least a portion of the dispensing tube as a bellows and securing the dispensing tube to the push bar such that, upon actuating the push bar, the bellows is collapsed from an expanded volume to a compressed volume and the outlet moves with said push bar.

DETAILED DESCRIPTION OF THE INVENTION

Figure 2:
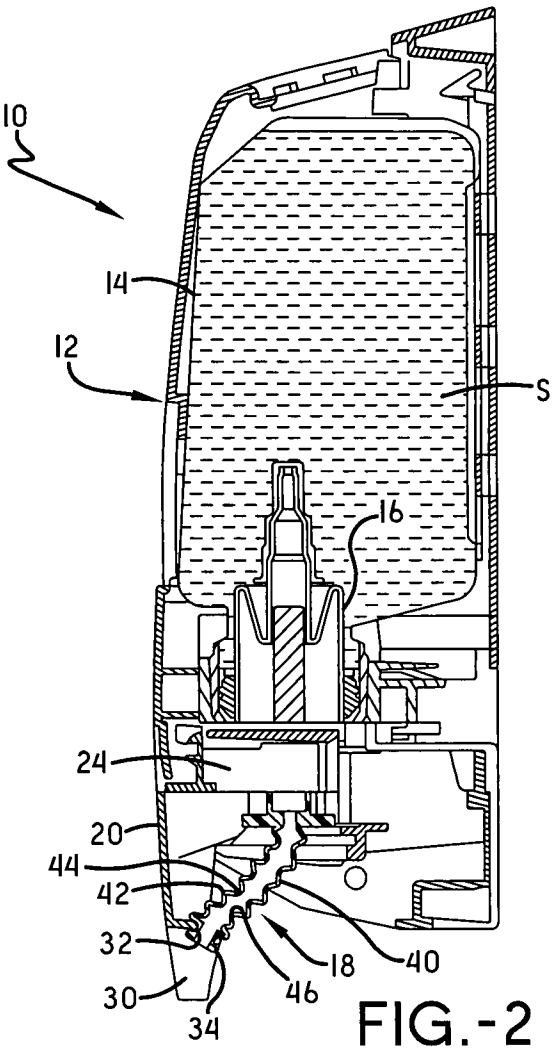
FIG. 2 is a stepped cross sectional view of the dispenser of FIG. 1, taken along the line 2-2.
Figure 1:
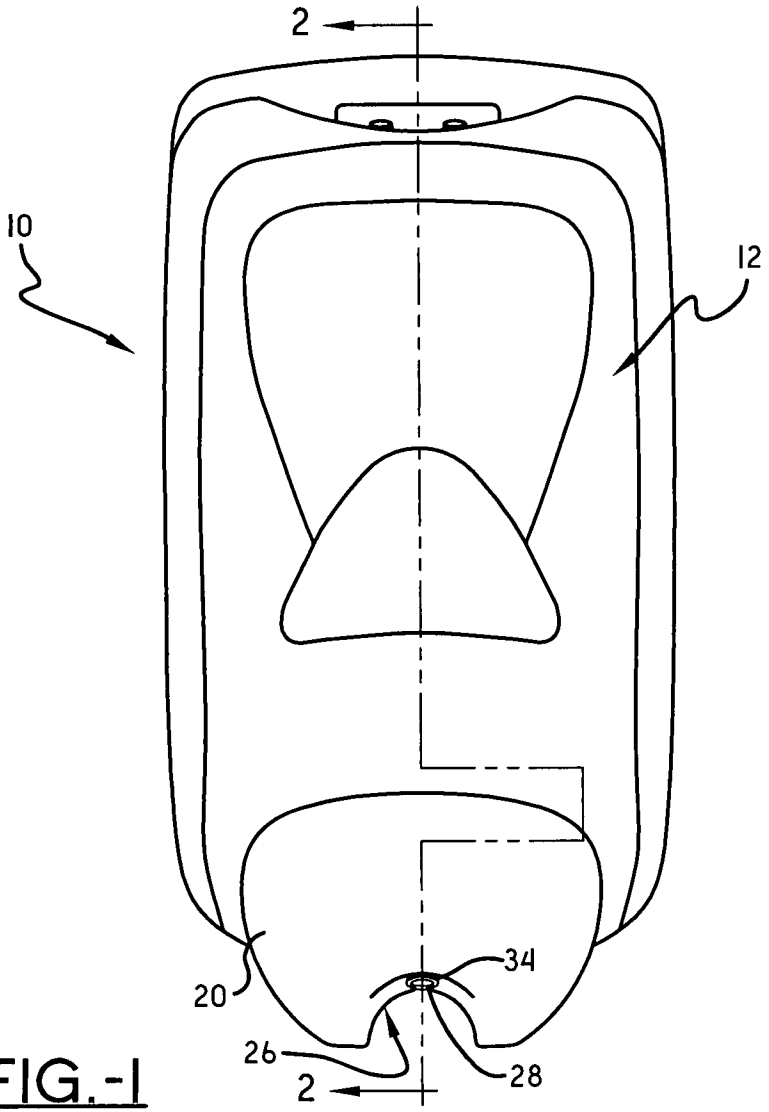
FIG. 1 is a front elevational view of the dispenser of this invention.
Figure 3:
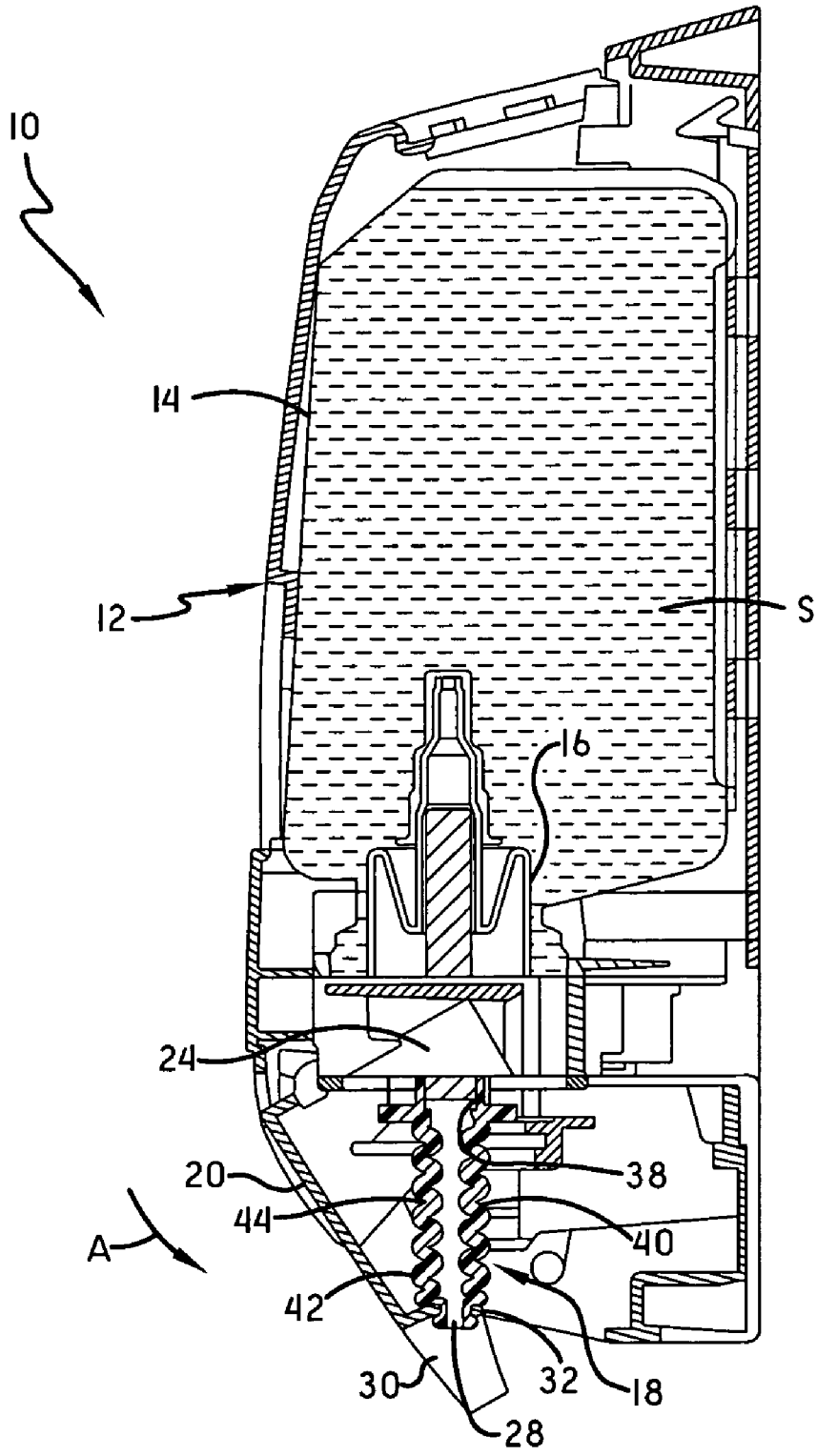
FIG. 3 is a stepped cross sectional similar to that in FIG. 2, but shown at an actuated position wherein the pump has been actuated by the fins of the push bar.

With reference to FIGS. 1-3, a dispenser in accordance with this invention is shown and designated by the numeral 10. The dispenser 10 includes a housing 12 that receives a container 14 holding liquid S for dispensing. A pump 16 is associated with the liquid S in the container 14, and is actuated to dispense a dose of the liquid S through a dispensing tube 18 associated with the pump 16. The pump 16 is actuated by movement of a push bar 20, which is typically associated with the housing 12, though this invention is not limited to or by that particular structure.

Figure 4:
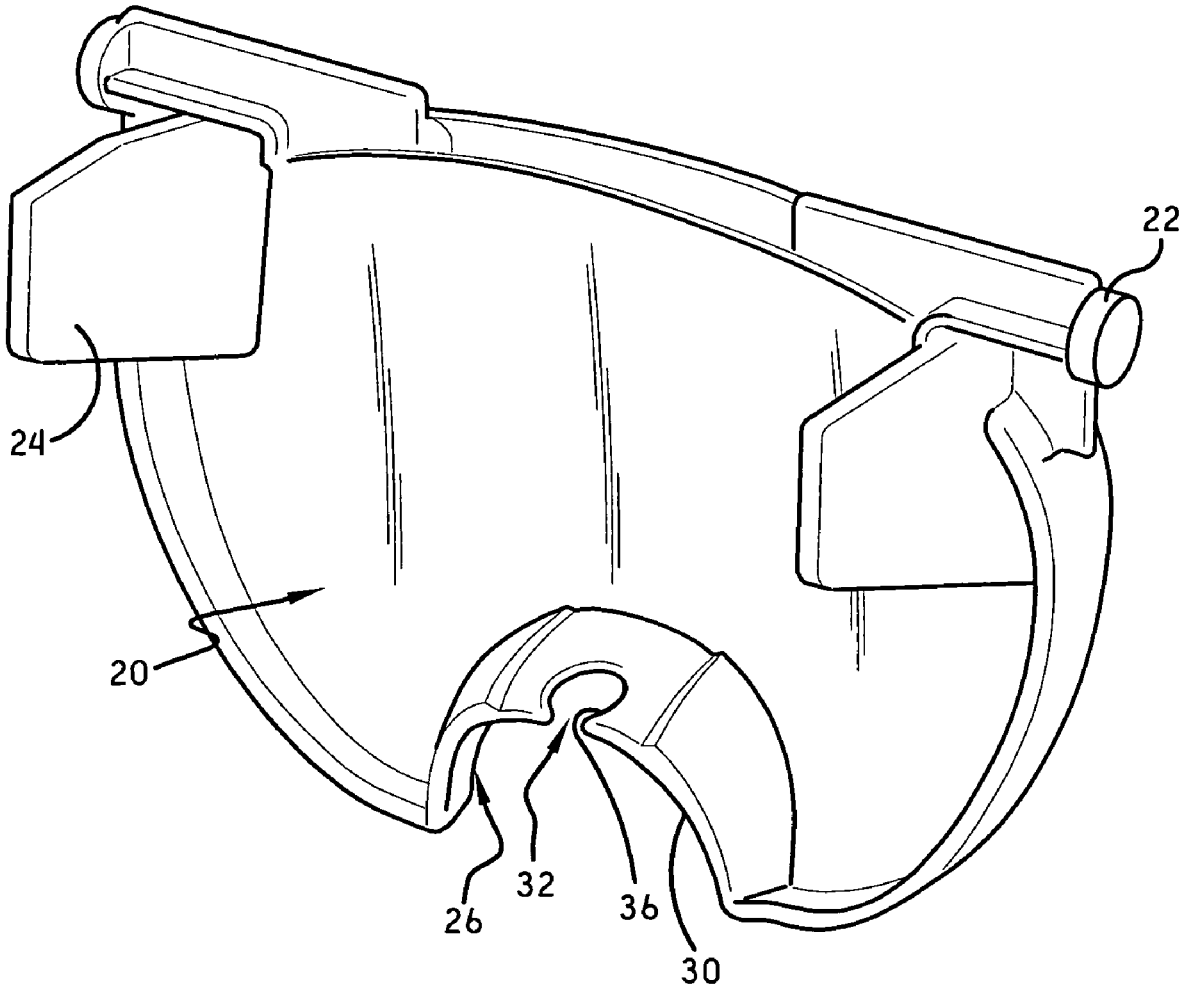
FIG. 4 is a perspective view showing the structure of an embodiment of a push bar in accordance with this invention.

In this embodiment, the pump 16 is a reciprocating piston pump for dispensing either the liquid S alone or a mixture of the liquid S and air to create foam. Such piston pumps are well known, and the present invention is not limited to such a particular pump, it being sufficient for purposes of this invention that the pump be of a type that is actuated by movement of a push bar. For example, a dome pump or bellows pump wherein a collapsible dome or bellows is compressed by movement of a push bar to dispense liquid would also be suitable. Thus, the push bar 20 is pivotally secured to the housing 12, as at hinge 22 (FIG. 4), to be movable between a rest position, as seen in FIG. 2, and an actuated position, as seen in FIG. 3. In the rest position, the pump 16 is not acted upon, and it too remains at rest. However, as the push bar 20 is moved to the actuated position, the pump 16 is acted upon and moved to an actuated position to pump either the liquid S or the liquid S and air (when the pump 16 is a foam pump). In the embodiment shown, one or more fins 24 extend from the push bar 20 to engage the pump 16 or an auxiliary structure that engages the pump 16, and these fins 24 pivot with the push bar 20, such that they actuate the pump 16 (either directly or through the auxiliary structure) as push bar 20 is moved in the direction of arrow A, from the rest position of FIG. 2, to the actuated position of FIG. 3.

It will be appreciated that various types of push bar actuated dispensers are known in the art, this invention is not limited to any particular pump or push bar structure necessary to actuate that pump. The embodiment in the figures shows a reciprocating pump, though it is represented very symbolically in light of it being well known. However, the inventive concepts herein respecting a dispensing tube are readily applicable to different push bar actuated dispensers, for example, those employing what are now known as dome pumps, wherein a flexible dome defining a dose volume is collapsed to the dispense fluid and is expanded to draw in a dose of fluid. Thus, it should be appreciated that the scope of this invention potentially covers any push bar actuated dispenser.

As seen in FIGS. 1-4, the push bar 20 includes a dispensing tube adaptor 26 that is provided to selectively receive the dispensing tube 18 associated with the pump 16. The dispensing tube adaptor 26 is used to secure the dispensing tube 18 to the push bar 20 such that the outlet 28 of the dispensing tube 18 moves with the push bar 20. In this embodiment, a concave wall 30 in the push bar 20 extends in the direction of movement of the push bar 20 and provides a mount 32 for the distal end 34 of the dispensing tube 18. This mount 32 can be any suitable selective securing structure, though it is shown here as a notch 36 that receives the distal end 34 through a friction fit. In this embodiment, the dispensing tube 18 is made from a resilient material that is forced into place at mount 32 to be held thereby. This is especially advantageous when the dispensing tube 18 is provided as part of a refill unit made up of the container, the pump, auxiliary structures (if employed), and the dispensing tube, because the dispensing tube is easily mounted to the push bar once the refill unit is mounted in the housing.

The dispensing tube 18 extends from an inlet 38 associated with the pump 16 to an outlet 28 associated with the push bar 20. Between the inlet 38 and the outlet 28, the dispensing tube 18 includes a bellows portion 40. In the embodiment shown, the entire dispensing tube 18 is formed of a bellows portion 40, but it should be appreciated that the inventive concepts herein would still be achieved by providing only a portion of the length of dispensing tube 18 as a bellows portion 40. Preferably, if only a portion of the dispensing tube 18 is to be formed as a bellows, the bellows portion would be closer to outlet 28. This places the ridges and valleys of the bellows portion 40 close to the outlet 28 such that they provide channels for holding liquid or foam sucked back into the dispensing tube. As seen in comparison of FIG. 2 and FIG. 3, upon moving the push bar 20 from the rest position to the actuated position, the bellows portion 40 is collapsed from an expanded volume (FIG. 2) to a compressed volume (FIG. 3) and the outlet 28 moves with the push bar 20. The dose of liquid dispensed is therefore dropped onto a consistent location on the operator's hand.

The push bar 20 is biased to its rest position by either the reciprocating mechanisms of the pump 16 or by a separate biasing mechanism. This is generally known in the art. Upon release of the push bar 20, it returns to its rest position, and this causes the bellows portion 40 of the dispensing tube 18 to expand to its expanded volume. As the bellows portion 40 expands, a vacuum is created, and liquid (or foam in the case of a foam pump) proximate the outlet 28 is sucked further back into the dispensing tube 18, thus minimizing or eliminating the potential for liquid to drip from the outlet 28.

In this embodiment, the bellows portion 40 is corrugated, as at ridges 42 and valleys 44, and is made of a material that provides the bellows portion 40 with the ability to reversibly collapse and extend between the compressed volume and the expanded volume shown. These ridges 42 and valleys 44 are advantageous in that they provide channels 46 for holding liquid away from outlet 28 to prevent dripping. They also collapse toward one another to decrease the volume of the bellows portion 40 as the dispenser 10 is actuated. More particularly, the distance between the inlet 38 and the distal end 34 of the dispensing tube 18 is greater in the unactuated, rest position than in the actuated position, and, as a result, at least a portion of the corrugated length of the dispensing tube 18 collapses onto itself as the push bar 20 is moved from the rest position to the actuated position. Similarly, as the push bar 20 moves from the actuated position to the rest position these collapsed portions expand.

In light of the foregoing, it should be clear that this invention provides improvements in the art of liquid dispensers. While a particular embodiment has been disclosed herein for the purpose of teaching the inventive concepts, it is to be appreciated that the invention is not limited to or by any particular structure shown and described. Rather, the claims shall serve to define the invention.

I claim:

1. A dispenser comprising:

a housing;

a push bar movable between a rest position and an actuated position;

a container retained in said housing and holding a liquid;

a pump associated with said liquid in said container, said pump being actuated to dispense a dose of said liquid when said push bar is moved from said rest position to said actuated position;

a dispensing tube including:

an inlet associated with said pump, an outlet, and a bellows portion between said inlet and said outlet, wherein said dispensing tube is secured to said push bar such that, upon moving said push bar from said rest position to said actuated position, said bellows is collapsed from an expanded volume to a compressed volume and said outlet moves with said push bar.

2. The dispenser of claim 1, wherein said push bar is pivotally mounted to said housing.

3. The dispenser of claim 1, wherein the length of the dispensing tube is altered by a collapsing and expanding of said bellows portion.

4. The dispenser of claim 1, wherein said pump is a reciprocating piston pump.

5. The dispenser of claim 1, wherein said pump is a dome pump.

* * * * *